US008009011B2

(12) United States Patent
Molin et al.

(10) Patent No.: US 8,009,011 B2
(45) Date of Patent: Aug. 30, 2011

(54) ELECTRICALLY ADJUSTABLE RESISTOR

(75) Inventors: Stuart B. Molin, Oceanside, CA (US); Paul Nygaard, Carlsbad, CA (US)

(73) Assignee: Semtech Corporation, Camarillo, CA (US)

( * ) Notice: Subject to any disclaimer, the term of this patent is extended or adjusted under 35 U.S.C. 154(b) by 641 days.

(21) Appl. No.: 12/147,368

(22) Filed: Jun. 26, 2008

(65) Prior Publication Data

US 2009/0002120 A1 Jan. 1, 2009

Related U.S. Application Data

(60) Provisional application No. 60/947,372, filed on Jun. 29, 2007.

(51) Int. Cl.
*H01C 10/00* (2006.01)

(52) U.S. Cl. ..... 338/195; 257/538; 257/384; 438/382; 438/530

(58) Field of Classification Search ..... 338/195, 338/198, 215, 334, 252, 322; 257/538, 380, 257/384, 534; 324/158.1, 765, 73.1; 438/382, 438/384, 50, 530, 764
See application file for complete search history.

(56) References Cited

U.S. PATENT DOCUMENTS

| | | | | |
|---|---|---|---|---|
| 5,837,592 | A * | 11/1998 | Chang et al. | 438/382 |
| 6,087,677 | A * | 7/2000 | Wu | 257/50 |
| 7,199,016 | B2 * | 4/2007 | Heston et al. | 438/382 |
| 2006/0054975 | A1 * | 3/2006 | Chen et al. | 257/384 |

* cited by examiner

*Primary Examiner* — Kyung Lee
(74) *Attorney, Agent, or Firm* — O'Melveny & Myers LLP

(57) ABSTRACT

An electrically adjustable resistor comprises a resistive polysilicon layer dielectrically isolated from one or more doped semiconducting layers. A tunable voltage is applied to the doped semiconducting layers, causing the resistance of the polysilicon layer to vary. Multiple matched electrically adjustable resistors may be fabricated on a single substrate, tuned by a single, shared doped semiconductor layer, creating matched, tunable resistor pairs that are particularly useful for differential amplifier applications. Multiple, independently adjustable resistors may also be fabricated on a common substrate.

39 Claims, 3 Drawing Sheets

ELECTRICALLY ADJUSTABLE RESISTOR

RELATED APPLICATION DATA

This application claims the benefit, pursuant to 35 U.S.C. §119(e), of U.S. provisional application Ser. No. 60/947,372, filed Jun. 29, 2007.

BACKGROUND OF THE INVENTION

1. Field of the Invention

The present invention relates generally to adjustable resistors and, more particularly, to polysilicon resistors that can be electrically adjusted to a precise resistance value.

2. Description of Related Art

Resistors with precise resistance values are useful for a variety of applications. FIG. 1 shows a typical prior art differential amplifier, which is one application where precision resistors can be used. Differential amplifiers have been known in the prior art and are used to multiply the difference between two inputs of the amplifier by a constant factor. The differential amplifier shown in FIG. 1 includes an operational amplifier (i.e., "op amp") 10, resistors 12, 14, 16, and 18, and voltage source $V_{IN}$. The inverting input of the op amp 10 is connected to the junction of the pair of resistors 12 and 14, which are disposed in series between the negative output of $V_{IN}$ and the output of the op amp 10 (shown as $V_{OUT}$). The non-inverting input of op amp 10 is connected to the junction of the pair of resistors 16 and 18, which are disposed in series between the positive output of $V_{IN}$ and ground (GND). Resistors 16 and 18 are also used to remove amplifier offset. Ideally, the ratios of resistor 14 to resistor 12 and resistor 18 to resistor 16 should be equal. When the ratios are equal, the output voltage $V_{OUT}$ will not change when the inverting and non-inverting inputs are tied together and a voltage $V_{IN}$ is applied to both inputs.

In practice, however, it is difficult to manufacture a polysilicon resistor with a precise resistance value. Polysilicon resistors are simple and inexpensive to fabricate, but their resistance values can change with applied voltage and temperature. Polysilicon resistors generally have resistance tolerances ranging from 15 to 20%. When the resistor ratios in the differential amplifier discussed above are not equal to each other, a common mode error (CME) will result. The magnitude of the CME is a measure of the inability of a differential amplifier to block common-mode components of a signal while amplifying the differential signal. CME is an important parameter in applications where the signal of interest is superimposed on a voltage offset or when relevant information is contained in the voltage difference between two signals.

Precise resistance values are important in other applications as well, including precision measurement devices, such as the ones described in the commonly-owned patents, U.S. Pat. No. 6,828,775, issued Dec. 7, 2004, entitled "HIGH-IMPEDANCE MODE FOR PRECISION MEASUREMENT UNIT," and U.S. Pat. No. 7,154,260, issued Dec. 26, 2006, entitled "PRECISION MEASUREMENT UNIT HAVING VOLTAGE AND/OR CURRENT CLAMP POWER DOWN UPON SETTING REVERSAL," which are incorporated herein, in their entireties, by reference. The precision measurement units described in these patents generally relate to the field of automatic test equipment for semiconductor devices. Precision resistors are helpful in obtaining the precision measurements required in the automatic test equipment.

Various methods have been used in the prior art to achieve precise resistance values. One method is to use an adjustable component such as a potentiometer, which is a type of variable resistor. A designer would use a potentiometer during testing until the desired function of the circuit had been reached. When used in a differential amplifier as shown in FIG. 1, the potentiometer can be adjusted so that the common-mode signal is nearly completely rejected. One disadvantage of using a potentiometer is cost, particularly when very expensive potentiometers must be used for high-precision differential amplifiers. Another disadvantage is that long-term stability is difficult to achieve with the use of potentiometers.

Another method of obtaining a precise resistance value for thin-film metal resistors is through laser trimming. Laser trimming is the controlled alteration of a capacitor or resistor geometry by laser ablation. For a thin-film metal resistor, resistance is determined by the resistor's composition and physical dimensions. Laser trimming alters the shape of the resistor, which in turn alters the resistance. For example, a lateral cut in the resistor material by the laser narrows the current flow path and increases the resistance value. One advantage of laser trimming is the permanence of the process. In most cases, automated laser trimming only requires a one-time adjustment, so the process is less susceptible to error and re-work. Other advantages include high precision and reliability. Laser trimming, however, has some disadvantages as well. The cost of buying and operating laser trimming systems can be extremely high, and the process itself can be time-consuming. Laser trimming is also not useful for polysilicon resistors.

Thus, there exists a need for a polysilicon resistor that can be adjusted to a precise value in a cost-effective manner.

SUMMARY OF THE INVENTION

An electrically adjustable resistor is created from a polysilicon resistive layer by taking advantage of a property of polysilicon by which the resistance changes as a function of an applied voltage. All polysilicon exhibits a voltage coefficient of resistance (VCR) that describes the small change in resistance that occurs as a result of applied voltage. A typical polysilicon resistor exhibits a VCR in the neighborhood of $1\times10^{-4}$ parts per million per volt (ppm/V), which is very small and does not allow for significant tuning of the resistance. However, in accordance with the present invention, a polysilicon resistor can be deposited onto a thin dielectric layer separating the polysilicon resistor from a doped substrate acting as an adjustment layer. When a voltage is applied to the adjustment layer, the VCR of the polysilicon resistor is enhanced by over an order of magnitude, and adjustments to the voltage applied to the adjustment layer will cause the resistance of the polysilicon layer to vary with sufficient magnitude to make the device useful as an electronically tunable variable resistor.

In an embodiment of a variable resistor in accordance with the present invention, a substrate is doped with ions to create an adjustment region. A thin dielectric is deposited over the adjustment region, and two metal contacts are forced through the dielectric to make electrical contact with the adjustment region near its edges. A polysilicon layer is then deposited on top of the dielectric layer, above the adjustment region and between the metal contacts. A voltage source is connected between the metal contacts such that a voltage can be applied across the adjustment layer. The polysilicon layer can be connected to an electrical circuit to act as a resistor. When the voltage source connected between the metal contacts is varied, changing the voltage applied across the adjustment region, the resistance of the polysilicon layer changes. The precise value of the resistance of the polysilicon layer can thus be actively controlled by controlling the voltage applied across the adjustment region.

In one embodiment of a variable resistor, the voltage source connected to the adjustment layer comprises a digital-to-analog converter (DAC) that can be digitally programmed to output a precise analog voltage. A DAC may be connected to each of the two metal contacts connected to the adjustment region in order to control the voltage applied to the adjustment region. Many DACs include both a standard output and a complementary output that are both controlled by the same digital control word. In this case, a single DAC can be used, the standard output connected to one of the metal contacts connected to the adjustment region, and the complementary output connected to the other.

For high-precision applications, it may be desirable to operate the DAC or other voltage source in such a way that the voltage applied across the polysilicon resistive layer by the circuit is tracked by the voltage applied by the DAC to the adjustment layer. In other words, the DAC may be operated to maintain a substantially constant offset voltage between the voltage applied to the adjustment layer and the voltage the circuit applies to the polysilicon resistor.

The substrate may comprise an n-type silicon material or a p-type silicon material, or any other substrate used in the manufacture of electronic circuits. If an n-type substrate is used, the adjustment layer will be doped with ions to create a p-type well. If a p-type substrate is used, the adjustment layer will be doped with ions to create an n-type well.

An embodiment of an electrically adjustable resistor in accordance with the present invention will generally include a dielectric layer that is between approximately 50 Angstroms and 5000 Angstroms thick, with thinner dielectric layers tending to cause a larger VCR in the adjustable polysilicon resistor. The thickness of the polysilicon resistive layer will typically be between 0.1 and 0.4 micrometers, with thinner layers resulting in higher resistance and a larger VCR. The resistance of the polysilicon layer is typically between 50 and 5000 Ohms per square.

In another embodiment of an electrically adjustable resistor in accordance with the present invention, the adjustability of the polysilicon resistor is increased by including a second dielectric layer and a second adjustment layer on top of the polysilicon resistive layer. In this embodiment, the polysilicon resistor is sandwiched between two layers of dielectric with a first adjustment region below and a second adjustment layer above the resistor, enhancing the VCR. The second dielectric layer is deposited on top of the polysilicon resistive layer and may extend beyond and wrap around the polysilicon layer. Metal contacts are forced through the second dielectric layer to make electrical contact with the polysilicon resistive layer so that it can be connected to an electrical circuit. The second adjustment layer is deposited on top of the second dielectric layer, above the polysilicon layer and between the metal contacts contacting the polysilicon resistive layer. A second voltage source is connected between one edge of the second adjustment layer and its other edge in order to apply a second voltage to the second adjustment layer. Operated independently, the first voltage source and the second voltage source are used to adjust the resistance of the polysilicon adjustment layer.

As in the first embodiment discussed above, the second voltage source may comprise a DAC having a standard output and a complementary output connected to corresponding edges of the second adjustment region. The second adjustment region may comprise n-type doped silicon or p-type doped silicon, or any other kind of doped semiconductor used in the manufacture of electronic circuits.

In still another embodiment of an electrically adjustable resistor, a pair of resistors is created by depositing two polysilicon layers onto a dielectric layer. In this embodiment, a substrate is doped with ions to create an extended adjustment region large enough that two or more polysilicon resistors can be placed above it. A dielectric layer is deposited onto the substrate above the extended adjustment region, and metal contacts are forced through the dielectric to make contact with the adjustment region. A first polysilicon structure and a second polysilicon structure are then deposited on top of the dielectric layer such that both polysilicon resistors are situated above the adjustment region but separated from each other. A voltage source is connected to the metal contacts making contact with the adjustment layer such that a voltage may be applied across the adjustment layer. When the voltage across the adjustment layer is varied, the resistances of the two polysilicon resistors change. Because the resistors share a common adjustment layer and are fabricated at the same time by the same process, they tend to be well matched and will vary similarly to one another with the voltage applied to the adjustment region. Thus, such a matched pair would be well suited for use in a differential amplifier circuit, for example, as resistors 16 and 18 of the circuit in FIG. 1. More than two matched resistors can be produced if desired by creating additional polysilicon resistive structures on top of the dielectric layer.

In still another embodiment of an electrically adjustable resistor in accordance with the present invention, a resistor pair including two resistors that are independently adjustable is achieved. Just like in the embodiment described previously, two polysilicon resistors are deposited on a dielectric layer above an extended adjustment region. However, in this case, an additional dielectric layer is deposited over the first polysilicon resistor and the second polysilicon resistor. Metal resistor contacts are forced through the additional dielectric layer to provide electrical contacts for the first and second resistors. A second adjustment layer is then deposited on top of the second dielectric layer above the first polysilicon resistor and a second voltage source is connected across this second adjustment layer. A third adjustment layer is deposited on top of the second dielectric layer above the second polysilicon resistor and a third voltage source is connected across this third adjustment layer. The resistances of the first and second polysilicon resistors are then controlled by a combination of the three voltages applied to the first, second, and third adjustment layers, respectively. The first voltage applied to the first adjustment layer affects the resistance of both the first and second resistor in the same way. The second voltage applied to the second adjustment layer affects only the resistance of the first polysilicon resistor. The third voltage applied to the third adjustment layer affects only the resistance of the second polysilicon resistor. Thus, the pair of electrically adjustable resistors can be controlled independently. More than two resistors can be created in a similar fashion by depositing more than two polysilicon resistive structures on top of the first dielectric and creating corresponding additional adjustment layers on top of each of the polysilicon resistors controlled by corresponding additional voltage sources.

Additional configurations of polysilicon resistive layers dielectrically isolated from and in close proximity to doped adjustment layers are also possible and would fall within the scope and spirit of the present invention. Other advantages and variations of the invention may become clear to those skilled in the art after studying the following detailed description and attached sheets of drawing that will first be described briefly.

DETAILED DESCRIPTION OF THE PREFERRED EMBODIMENT

The present invention satisfies the need for an improved and cost-effective way of adjusting resistance values in polysilicon resistors.

Figure 2:
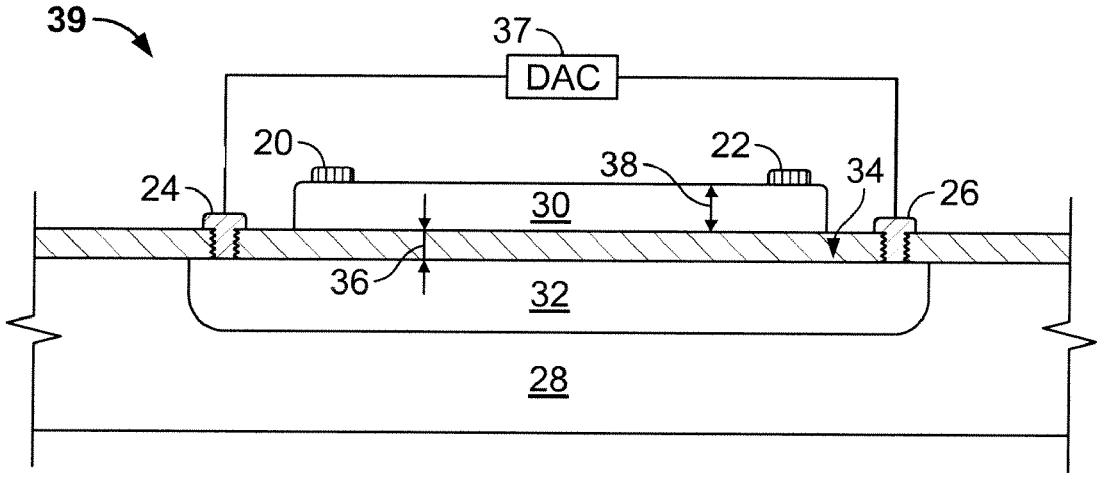
FIG. 2 is a cross-sectional view of an electrically adjustable resistor in accordance with an embodiment of the invention.

FIG. 2 provides a cross-sectional view of an electrically adjustable resistor in accordance with a preferred embodiment of the invention. The electrically adjustable resistor 39 comprises four regions: substrate 28, adjustment layer 32, polysilicon resistor layer 30, and dielectric 34. The substrate 28 forms the base on which additional materials and layers can be added. Substrate 28 can be made of either an n-substrate or a p-substrate. Ions are implanted into the substrate 28 to form the adjustment layer 32, which is an isolated p-well or n-well, depending on whether the substrate 28 is an n-substrate or a p-substrate. If an n-substrate is used, then the adjustment layer 32 will be an isolated p-well. If a p-substrate is used, then the adjustment layer 32 will be an isolated n-well. Dielectric layer 34 is formed atop adjustment layer 32 and substrate 28. Metal contacts 24 and 26 fill two holes etched from the dielectric layer 34. The metal contacts 24 and 26 are located near the ends of the adjustment layer 32 and are connected to a digital-analog converter (i.e., DAC) voltage source 37, though other types of voltage sources may be used. The polysilicon resistor layer 30 is formed atop the dielectric layer 34 and between metal contacts 24 and 26. Metal contacts 20 and 22 are formed atop the polysilicon resistor layer 34 and are located near the ends of the layer.

The resistance of polysilicon resistor layer 30 depends on the layer's length, width, and height, along with the specific polysilicon used to make the layer. Adjustment of the resistance value of the polysilicon resistor layer 30 can be performed by applying a DAC output voltage across the adjustment layer 32 through metal contacts 24 and 26. More specifically, only one DAC voltage source 37 is needed, where the standard DAC output voltage is applied to metal contact 24 while the complement of the DAC output voltage is applied to metal contact 26. The standard DAC output voltage and the complement of the DAC output voltage should track the voltage applied to the polysilicon resistor layer 30 to ensure a constant relative voltage difference between the polysilicon resistor layer 30 and adjustment layer 32.

The electrically adjustable resistor of the present invention takes advantage of a characteristic found in all polysilicon resistors known as the voltage coefficient of resistance (VCR). The VCR represents the unit change in resistance per unit change in voltage expressed as ppm/volt. VCR can be represented as follows:

$$VCR=(1/R)*(dR/dV)$$

where R is the resistance and V is the average voltage applied to the resistor, which is the sum of the voltages on each end of the resistor divided by two. Thus, the resistance of polysilicon resistor layer 30 will change as a voltage applied to metal contacts 20 and 22 changes. However, the VCR of polysilicon resistor layer 30 also depends on the relation between polysilicon resistor layer 30 and adjustment layer 32. More specifically, the VCR depends on the following: the material used in the polysilicon resistor layer 30, the material used in the adjustment layer 32, the material used in the dielectric layer 34, and the distance 36 between the polysilicon resistor layer 30 and adjustment layer 32.

A polysilicon resistor typically has a VCR of $1.0\times10^{-4}$ ppm/v. More lightly doped resistors will have a larger VCR, so for example, an 80 Ω/square resistor has a VCR of about $3.0\times10^{-5}$ while a 3000 Ω/square resistor of the same oxide thickness has a VCR of about $3.0\times10^{-4}$. In most polysilicon resistor designs, it is desirable to keep the VCR small to limit the variations in resistance when the voltage changes. The electrically adjustable resistor of the present invention, however, has a VCR of about $4.0\times10^{-3}$, which is much larger than the VCR in a typical polysilicon resistor. This larger VCR is made possible by a thin dielectric and a high sheet resistance. A larger VCR allows for the adjustment of the resistance of the polysilicon resistor layer 30 by the application of a voltage to the adjustment layer 32.

The dimensions and materials used to make the electrically adjustable resistor are as follows: the height 36 of dielectric layer 34 is preferably between 50 Å and 5,000 Å, and the composition of dielectric layer 34 can include any commonly known dielectric. The height 38 of the polysilicon resistor layer 30 is preferably between 0.1 μm and 0.4 μm, and the sheet resistance of polysilicon resistor layer 30 is preferably between 500 Ω/square to 5,000 Ω/square. The composition of the polysilicon resistor layer 30 can include any commonly known polysilicon that possesses these characteristics.

Figure 3:
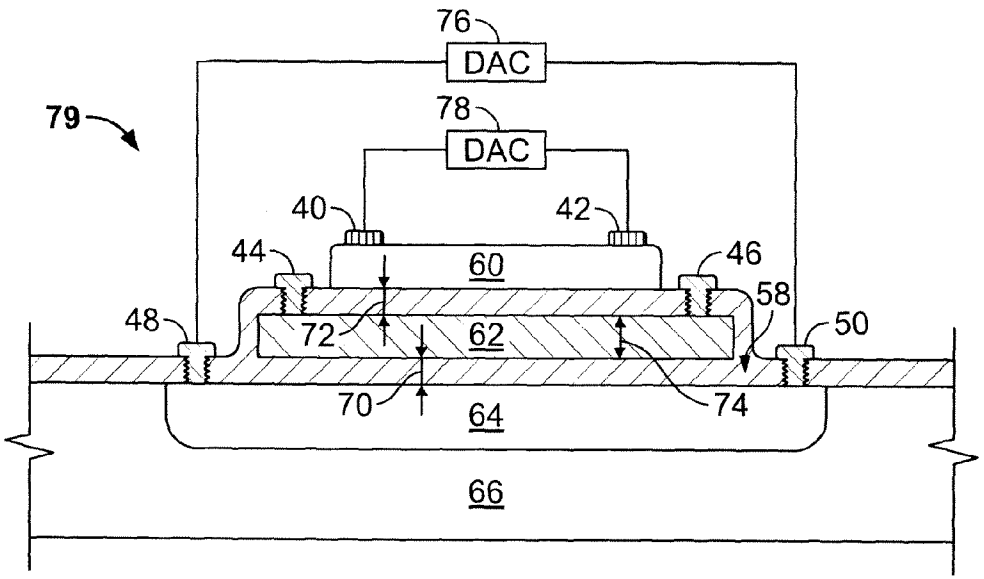
FIG. 3 is a cross-sectional view of an electrically adjustable resistor in accordance with another embodiment of the invention.

FIG. 3 provides a cross-sectional view of another embodiment of the present invention. FIG. 3 is very similar to FIG. 2, except it provides for an additional adjustment layer atop the polysilicon resistor layer. The electrically adjustable resistor 79 comprises five regions: substrate 66, first adjustment layer 64, polysilicon resistor layer 62, dielectric 58, and second adjustment layer 60. The substrate 66 forms the base on which additional materials and layers can be added. Substrate 66 can be made of either an n-substrate or a p-substrate. Ions are implanted into the substrate 66 to form the first adjustment layer 64, which is an isolated p-well or n-well, depending on whether the substrate 66 is an n-substrate or a p-substrate. If an n-substrate is used, then the first adjustment layer 64 will be an isolated p-well. If a p-substrate is used, then the first adjustment layer 64 will be an isolated n-well. Dielectric 58 is formed atop first adjustment layer 64 and substrate 66, and in this embodiment, dielectric 58 also extends and surrounds the polysilicon resistor layer 62. Metal contacts 48 and 50 fill two holes etched from the dielectric 58. The metal contacts 48 and 50 are located near the ends of the first adjustment layer 64 and are connected to a DAC voltage source 76. The polysilicon resistor layer 62 is formed atop the dielectric 58 and between metal contacts 48 and 50. Metal contacts 44 and 46 fill additional holes etched from the dielectric 58, and the metal contacts 44 and 46 are located near the ends of the polysilicon resistor layer 62. A second adjustment layer 60 is formed atop the portion of the dielectric 58 that is formed atop the polysilicon resistor layer 62. Metal contacts 40 and 42 are provided atop the second adjustment layer 60 and are located near the ends of the layer. Metal contacts 40 and 42 are also connected to a DAC voltage source 76.

As in the previous embodiment, the resistance of polysilicon resistor layer 62 depends on the layer's length, width, and height, along with the specific polysilicon used to make the layer. In this embodiment, adjustment of the resistance value of the polysilicon resistor layer 62 can be performed by applying a DAC output voltage through a DAC voltage source 76 across the first adjustment layer 64 through metal contacts 48 and 50 and across the second adjustment layer 60 through metal contacts 40 and 42. Only one DAC voltage source 76 is needed, where the standard DAC output voltage is applied to metal contact 48 while the complement of the DAC output voltage is applied to metal contact 50. Likewise for the second adjustment layer 60, the standard DAC output voltage is applied to metal contact 40 while the complement of the DAC output voltage is applied to metal contact 42. The standard DAC output voltage and the complement of the DAC output voltage from the DAC voltage source 76 should track the voltage applied to the polysilicon resistor layer 62 to ensure a constant relative voltage difference between the polysilicon resistor layer 62 and adjustment layers 60 and 64. Having two adjustment layers allows for more precise adjustment of the resistance.

The dimensions and materials are similar to the dimensions and materials from the previous embodiment. The first height 70 and the second height 72 of dielectric layer 58 are both preferably between 50 Å and 5,000 Å, and the composition of dielectric 58 can include any commonly known dielectric. The height 74 of the polysilicon resistor layer 62 is preferably between 0.1 μm and 0.4 μm, and the sheet resistance of polysilicon resistor layer 62 is preferably between 500 Ω/square to 5,000 Ω/square. The composition of the polysilicon resistor layer 62 can include any commonly known polysilicon that possesses these characteristics.

Figure 4:
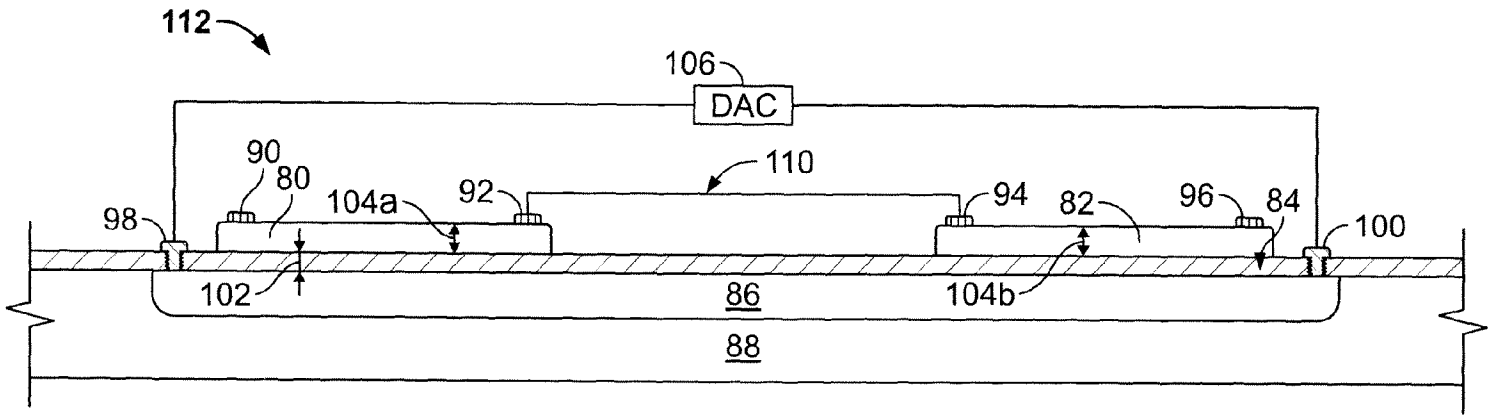
FIG. 4 is a cross-sectional view of an electrically adjustable resistor in accordance with yet another embodiment of the invention.

FIG. 4 provides a cross-sectional view of yet another embodiment of the present invention. FIG. 4 is very similar to FIG. 2, except it provides for an extended adjustment layer below two separate polysilicon resistor layers. The electrically adjustable resistor 112 comprises five regions: substrate 88, adjustment layer 86, first polysilicon resistor layer 80, second polysilicon resistor layer 82, and dielectric layer 84. The substrate 88 forms the base on which additional materials and layers can be added. Substrate 88 can be made of either an n-substrate or a p-substrate. Ions are implanted into the substrate 88 to form the adjustment layer 86, which is an isolated p-well or n-well, depending on whether the substrate 88 is an n-substrate or a p-substrate. If an n-substrate is used, then the adjustment layer 86 will be an isolated p-well. If a p-substrate is used, then the adjustment layer 86 will be an isolated n-well. Dielectric layer 84 is formed atop adjustment layer 86 and substrate 88. Metal contacts 98 and 100 fill two holes etched from the dielectric layer 84. The metal contacts 98 and 100 are located near the ends of the adjustment layer 86 and are connected to a DAC voltage source 106. The first polysilicon resistor layer 80 and the second polysilicon resistor layer 82 are formed apart from each other and atop the dielectric layer 84 between metal contacts 98 and 100. Metal contacts 90 and 92 are formed atop the first polysilicon resistor layer 80 and are located near the ends of the layer. Likewise, metal contacts 94 and 96 are formed atop the second polysilicon resistor layer 82 and are located near the ends of the layer. Additionally, polysilicon resistor layers 80 and 82 are connected by wire 110 through metal contacts 92 and 94.

Figure 1:
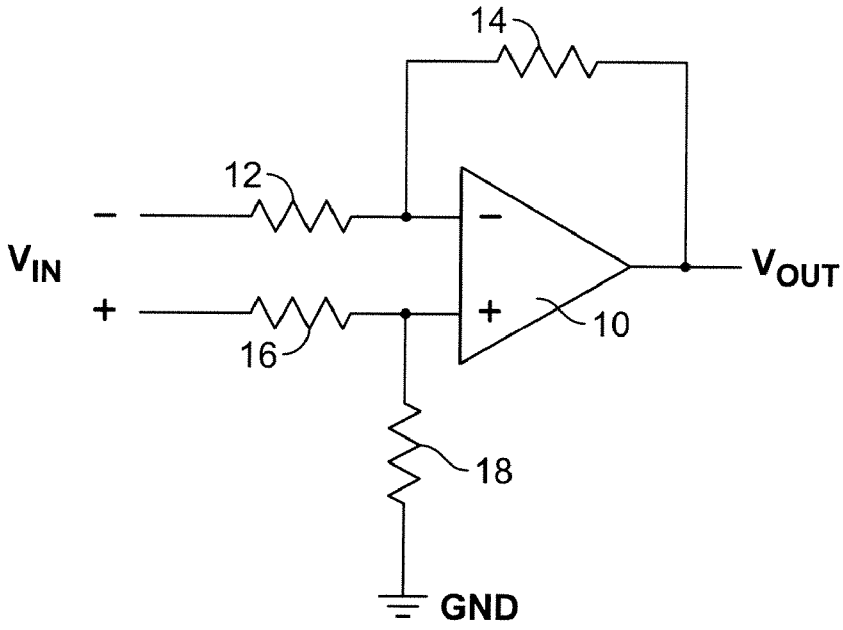
FIG. 1 (Prior Art)
FIG. 1 is a diagram of a prior art differential amplifier circuit.

As in the previous embodiments, the resistance of polysilicon resistor layers 80 and 82 depends on the layers' length, width, and height, along with the specific polysilicon used to make the layers. Adjustment of the resistance value of the polysilicon resistor layers 80 and 82 can be performed by applying a DAC output voltage through a DAC voltage source 106 across the adjustment layer 86 through metal contacts 98 and 100. More specifically, only one DAC voltage source 106 is needed, where the standard DAC output voltage is applied to metal contact 98 while the complement of the DAC output voltage is applied to metal contact 100. The standard DAC output voltage and the complement of the DAC output voltage should track the voltage applied to the polysilicon resistor layers 80 and 82 to ensure a constant relative voltage difference between the polysilicon resistor layers 80 and 82 and adjustment layer 86. The electrically adjustable resistor shown in FIG. 4 could be used in the differential amplifier shown in FIG. 1, where resistor ratios from pairs of resistors need to be matched. When the electrically adjustable resistor of FIG. 4 is used in a differential amplifier, wire 110 is also connected to the inverting input of the operational amplifier.

The dimensions and materials are similar to the dimensions and materials from the previous embodiments. Height 102 of dielectric layer 84 is preferably between 50 Å and 5,000 Å, and the composition of dielectric layer 84 can include any commonly known dielectric. The heights 104*a* and 104*b* of the polysilicon resistor layers 80 and 82 are both preferably between 0.1 μm and 0.4 μm, and the sheet resistance of polysilicon resistor layers 80 and 82 is preferably between 500 Ω/square to 5,000 Ω/square. The composition of the polysilicon resistor layers 80 and 82 can include any commonly known polysilicon that possesses these characteristics.

Figure 5:
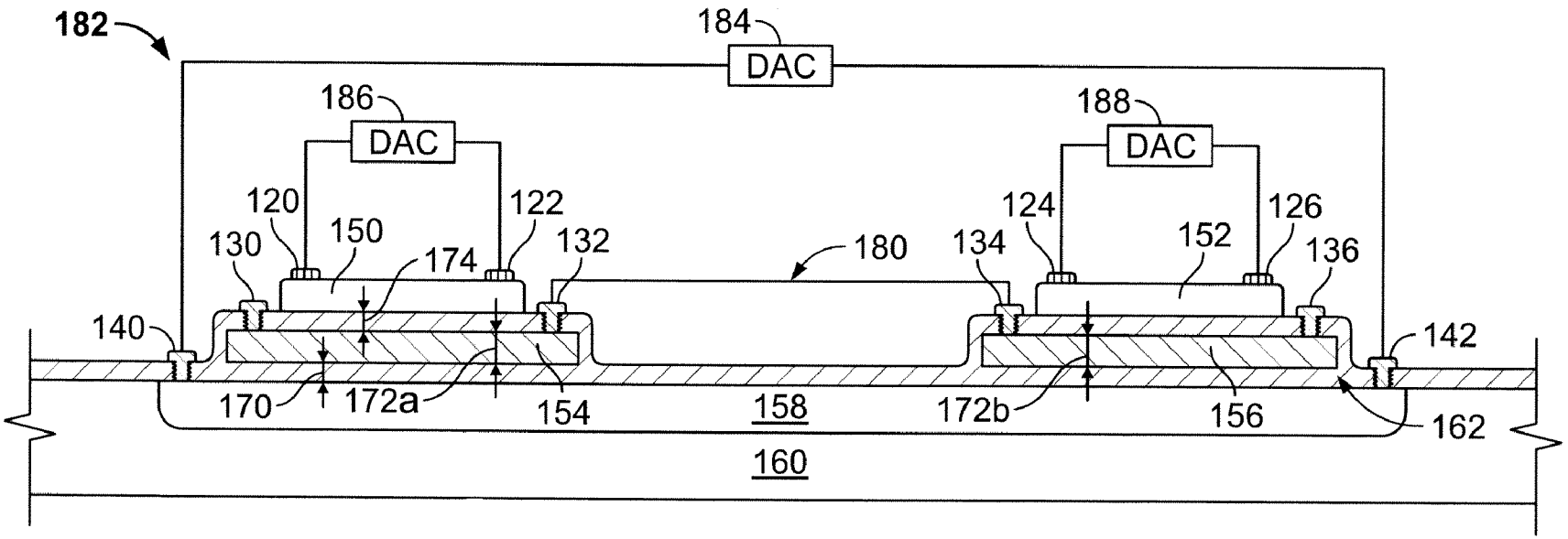
FIG. 5 is a cross-sectional view of an electrically adjustable resistor in accordance with yet another embodiment of the invention.

FIG. 5 provides a cross-sectional view of another embodiment of the present invention. FIG. 5 is very similar to FIG. 4, except it provides for additional adjustment layers atop the polysilicon resistor layers. The electrically adjustable resistor 182 comprises six regions: substrate 160, first adjustment layer 158, first polysilicon resistor layer 154, second polysilicon resistor layer 156, second adjustment layer 150, third adjustment layer 152, and dielectric 162. The substrate 160 forms the base on which additional materials and layers can be added. Substrate 160 can be made of either an n-substrate or a p-substrate. Ions are implanted into the substrate 160 to form the first adjustment layer 158, which is an isolated p-well or n-well, depending on whether the substrate 160 is an n-substrate or a p-substrate. If an n-substrate is used, then the first adjustment layer 158 will be an isolated p-well. If a p-substrate is used, then the first adjustment layer 158 will be an isolated n-well. Dielectric 84 is formed atop first adjustment layer 158 and substrate 160, and in this embodiment, dielectric 84 extends and surrounds polysilicon resistor layers 154 and 156. Metal contacts 140 and 142 fill two holes etched from the dielectric layer 84. The metal contacts 140 and 142 are located near the ends of the first adjustment layer 158 and are connected to a DAC voltage source 184. The first polysilicon resistor layer 154 and the second polysilicon resistor layer 156 are formed apart from each other and atop the dielectric 162 between metal contacts 140 and 142. Metal contacts 130 and 132 fill additional holes etched from dielectric 162, and the metal contacts 130 and 132 are located near the ends of the first polysilicon resistor layer 154. Likewise, metal contacts 134 and 136 fill additional holes etched from dielectric 162, and the metal contacts 134 and 136 are located near the ends of the second polysilicon resistor layer 156. A second adjustment layer 150 is formed atop the portion of dielectric 162 that is formed atop the first polysilicon resistor layer 154. Metal contacts 120 and 122 are provided atop the second adjustment layer 150 and are located near the ends of the layer. Metal contact 120 is connected to DAC voltage source 184. A third adjustment layer 152 is formed atop the portion of dielectric 162 that is formed atop the second polysilicon resistor layer 156. Metal contacts 124 and 126 are provided atop the second adjustment layer 152 and are located near the ends of the layer. Metal contact 126 is connected to a DAC voltage source 184, and metal contact 126 is connected to metal contact 124 through wire 190. Additionally, polysilicon resistor layers 154 and 156 are connected by wire 180 through metal contacts 132 and 134.

As in the previous embodiments, the resistance of polysilicon resistor layers 150 and 152 depends on the layers' length, width, and height, along with the specific polysilicon used to make the layers. In this embodiment, adjustment of the resistance value of the polysilicon resistor layers 150 and 152 can be performed by applying a DAC output voltage through a DAC voltage source 184 across the first adjustment layer 158 through metal contacts 140 and 142 and across the second and third adjustment layers 150 and 152 through metal contacts 120 and 126. Only one DAC voltage source is needed, where the standard DAC output voltage is applied to one metal contact while the complement of the DAC output voltage is applied to the other metal contact. The standard DAC output voltage and the complement of the DAC output voltage from the DAC voltage source 184 should track the voltage applied to the polysilicon resistor layers 154 and 156 to ensure a constant relative voltage difference between the polysilicon resistor layers 154 and 156 and adjustment layers 158, 150, and 152. As with the electrically adjustable resistor shown in FIG. 4, the electrically adjustable resistor of FIG. 5 could also be used in the differential amplifier shown in FIG. 1, and having multiple adjustment layers allows for more precise adjustment of the resistances of the polysilicon resistor layers. When the electrically adjustable resistor of FIG. 5 is used in a differential amplifier, wire 180 is also connected to the inverting input of the operation amplifier.

The dimensions and materials are similar to the dimensions and materials from the previous embodiments. Heights 170 and 174 of dielectric 162 are preferably between 50 Å and 5,000 Å, and the composition of dielectric 162 can include any commonly known dielectric. The heights 172*a* and 172*b* of the polysilicon resistor layers 154 and 156 are both preferably between 0.1 μm and 0.4 μm, and the sheet resistance of polysilicon resistor layers 154 and 156 are preferably between 500 Ω/square to 5,000 Ω/square. The composition of the polysilicon resistor layers 154 and 156 can include any commonly known polysilicon that possesses these characteristics.

Having thus described a preferred embodiment of an electrically adjustable resistor, it should be apparent to those skilled in the art that certain advantages of the described method and apparatus have been achieved. It should also be appreciated that various modifications, adaptations, and alternative embodiments thereof may be made within the scope and spirit of the present invention.

What is claimed is:

1. An electrically adjustable resistor comprising:

a substrate;

an adjustment region comprising a portion of the substrate doped with ions;

a primary dielectric layer disposed on top of the substrate and in contact with the adjustment region, the primary dielectric layer including a first hole adapted to receive a first metal contact and a second hole adapted to receive a second metal contact, wherein the first and second metal contacts are each electrically connected to the adjustment region;

a voltage source electrically connected between the first metal contact and the second metal contact such that a voltage is applied across the adjustment region; and a polysilicon resistive layer deposited on top of the primary dielectric layer and situated above the adjustment region and between the first and second metal contacts;

wherein the polysilicon resistive layer is adapted to act as a variable resistor, a resistance of the variable resistor being adjusted by varying the voltage applied across the adjustment region by the voltage source.

2. The electrically adjustable resistor of claim 1, wherein the substrate comprises an n-type silicon material and the adjustment region doped with ions forms an isolated p-well.

3. The electrically adjustable resistor of claim 1, wherein the substrate comprises a p-type silicon material and the adjustment region doped with ions forms an isolated n-well.

4. The electrically adjustable resistor of claim 1, wherein the voltage source comprises a digital-to-analog converter (DAC) having a standard voltage output connected to the first metal contact and a complementary voltage output connected to the second metal contact.

5. The electrically adjustable resistor of claim 1, wherein a thickness of the primary dielectric layer measured between the adjustment region and the polysilicon resistive layer is between 50 Angstroms and 5000 Angstroms.

6. The electrically adjustable resistor of claim 1, wherein a thickness of the polysilicon resistive layer is between 0.1 micrometer and 0.4 micrometer.

7. The electrically adjustable resistor of claim 1, wherein a sheet resistance of the polysilicon resistive layer is between 500 Ohms per square and 5000 Ohms per square.

8. The electrically adjustable resistor of claim 1, further comprising:

a second dielectric layer deposited on top of the polysilicon resistive layer and extending beyond and around the polysilicon resistive layer, the second dielectric layer including a first hole adapted to receive a first metal resistor contact and a second hole adapted to receive a second metal resistor contact, wherein the first and second metal resistor contacts are each electrically connected to the polysilicon resistive layer;

a secondary adjustment layer deposited on top of the second dielectric layer above the polysilicon resistive layer and between the first and second metal resistor contacts; and a second voltage source connected between a first end of the secondary adjustment layer and a second end of the secondary adjustment layer such that a second voltage is applied across the secondary adjustment layer;

wherein the resistance of the polysilicon resistive layer can be further adjusted by varying the second voltage applied across the secondary adjustment region by the second voltage source.

9. The electrically adjustable resistor of claim 8, wherein the secondary adjustment region comprises silicon doped with ions to form a p-type semiconductor.

10. The electrically adjustable resistor of claim 8, wherein the secondary adjustment region comprises silicon doped with ions to form an n-type semiconductor.

11. The electrically adjustable resistor of claim 8, wherein the second voltage source comprises a DAC having a standard voltage output connected to the first end of the secondary adjustment layer and a complementary voltage output connected to the second end of the secondary adjustment layer.

12. The electrically adjustable resistor of claim 8, wherein a thickness of the second dielectric layer measured between the polysilicon resistive layer and the secondary adjustment layer is between 50 Angstroms and 5000 Angstroms.

13. An electrically adjustable resistor pair comprising:

a substrate;

an adjustment region comprising a portion of the substrate doped with ions;

a primary dielectric layer disposed on top of the substrate and in contact with the adjustment region, the primary dielectric layer including a first hole adapted to receive a first metal contact and a second hole adapted to receive a second metal contact, wherein the first and second metal contacts are each electrically connected to the adjustment region;

a voltage source electrically connected between the first metal contact and the second metal contact such that a voltage is applied across the adjustment region;

a first polysilicon resistive layer deposited on top of the primary dielectric layer and situated above the adjustment region and between the first and second metal contacts and closer to the first metal contact than to the second metal contact; and a second polysilicon resistive layer deposited on top of the primary dielectric layer and situated above the adjustment region and between the first and second metal contacts and closer to the second metal contact than to the first metal contact;

wherein the first polysilicon resistive layer is adapted to act as a first variable resistor, and the second polysilicon resistive layer is adapted to act as a second variable resistor, wherein resistances of the first and second variable resistors can be adjusted by varying the voltage applied across the adjustment region by the voltage source.

14. The electrically adjustable resistor pair of claim 13, wherein the substrate comprises an n-type silicon material and the adjustment region doped with ions forms an isolated p-well.

15. The electrically adjustable resistor pair of claim 13, wherein the substrate comprises a p-type silicon material and the adjustment region doped with ions forms an isolated n-well.

16. The electrically adjustable resistor pair of claim 13, wherein the voltage source comprises a digital-to-analog converter (DAC) having a standard voltage output connected to the first metal contact and a complementary voltage output connected to the second metal contact.

17. The electrically adjustable resistor pair of claim 13, wherein a thickness of the primary dielectric layer measured between the adjustment region and one of the first and second polysilicon resistive layers is between 50 Angstroms and 5000 Angstroms.

18. The electrically adjustable resistor pair of claim 13, wherein a thickness of the first and second polysilicon resistive layers is between 0.1 micrometer and 0.4 micrometer.

19. The electrically adjustable resistor pair of claim 13, wherein a sheet resistance of the first and second polysilicon resistive layers is between 500 Ohms per square and 5000 Ohms per square.

20. The electrically adjustable resistor pair of claim 13, further comprising an electrically conductive wire connected between the first variable resistor and the second variable resistor.

21. The electrically adjustable resistor pair of claim 13, further comprising:

a second dielectric layer deposited on top of the first polysilicon resistive layer and extending beyond and around the first polysilicon resistive layer, the second dielectric layer including a first hole adapted to receive a first metal resistor contact and a second hole adapted to receive a second metal resistor contact, wherein the first and second metal resistor contacts are each electrically connected to the first polysilicon resistive layer;

a second adjustment layer deposited on top of the second dielectric layer above the first polysilicon resistive layer and between the first and second metal resistor contacts;

a second voltage source connected between a first end of the second adjustment layer and a second end of the second adjustment layer such that a second voltage is applied across the second adjustment layer;

a third dielectric layer deposited on top of the second polysilicon resistive layer and extending beyond and around the second polysilicon resistive layer, the third dielectric layer including a third hole adapted to receive a third metal resistor contact and a fourth hole adapted to receive a fourth metal resistor contact, wherein the third and fourth metal resistor contacts are each electrically connected to the second polysilicon resistive layer;

a third adjustment layer deposited on top of the third dielectric layer above the second polysilicon resistive layer and between the third and fourth metal resistor contacts; and a third voltage source connected between a first end of the third adjustment layer and a second end of the third adjustment layer such that a third voltage is applied across the third adjustment layer;

wherein the resistance of the first variable resistor can be further adjusted by varying the second voltage applied across the second adjustment region by the second voltage source; and wherein the resistance of the second variable resistor can be further adjusted by varying the third voltage applied across the third adjustment region by the third voltage source.

22. The electrically adjustable resistor pair of claim 21, wherein the second adjustment region comprises silicon doped with ions to form a p-type semiconductor.

23. The electrically adjustable resistor pair of claim 21, wherein the second adjustment region comprises silicon doped with ions to form an n-type semiconductor.

24. The electrically adjustable resistor pair of claim 21, wherein the third adjustment region comprises silicon doped with ions to form a p-type semiconductor.

25. The electrically adjustable resistor pair of claim 21, wherein the third adjustment region comprises silicon doped with ions to form an n-type semiconductor.

26. The electrically adjustable resistor pair of claim 21, wherein the second voltage source comprises a DAC having a standard voltage output connected to the first end of the second adjustment layer and a complementary voltage output connected to the second end of the second adjustment layer.

27. The electrically adjustable resistor pair of claim 21, wherein the third voltage source comprises a DAC having a standard voltage output connected to the first end of the third adjustment layer and a complementary voltage output connected to the second end of the third adjustment layer.

28. The electrically adjustable resistor pair of claim 21, wherein a thickness of the second dielectric layer measured between the first polysilicon resistive layer and the second adjustment layer is between 50 Angstroms and 5000 Angstroms.

29. The electrically adjustable resistor pair of claim 21, wherein a thickness of the third dielectric layer measured between the second polysilicon resistive layer and the third adjustment layer is between 50 Angstroms and 5000 Angstroms.

30. A method for producing an electrically adjustable resistor comprises:

creating an adjustment region by doping a substrate with ions;

depositing a dielectric layer on top of the substrate and in contact with the adjustment region;

forming a first hole and a second hole through the dielectric layer such that the first and second holes are located above the adjustment region;

placing a first metal contact into the first hole and a second metal contact into the second hole such that the first and second metal contacts are each electrically connected to the adjustment region;

depositing a polysilicon resistive layer onto the dielectric layer above the adjustment region and between the first and second metal contacts;

adapting the polysilicon resistive layer to act as a variable resistor by connecting it to an electrical circuit;

connecting a voltage source between the first metal contact and the second metal contact to create a voltage across the adjustment region; and varying the voltage across the adjustment region to cause a change in a resistance of the variable resistor.

31. The method of claim 30, wherein the step of connecting a voltage source between the first metal contact and the second metal contact further comprises:

connecting a standard output of a digital-to-analog converter (DAC) to the first metal contact; and connecting a complementary output of the DAC to the second metal contact.

32. The method of claim 30, wherein the step of varying the voltage across the adjustment region further comprises:

detecting a voltage applied across the polysilicon resistive layer by the electrical circuit; and adjusting the voltage across the adjustment region to maintain a substantially constant voltage offset between the voltage applied across the polysilicon resistive layer by the electrical circuit and the voltage applied across the adjustment region.

33. The method of claim 30, further comprising:

creating additional variable resistors by the steps of:

depositing an additional polysilicon resistive layer onto the dielectric layer above the adjustment region and between the first and second metal contacts;

adapting the additional polysilicon resistive layer to act as an additional variable resistor by connecting it to an electrical circuit; and repeating the steps of depositing an additional polysilicon resistive layer and adapting the additional polysilicon resistive layer to act as a resistor until a desired number of variable resistors is created.

34. A method for producing an electrically adjustable resistor comprises:

creating a first adjustment region by doping a substrate with ions;

depositing a first dielectric layer on top of the substrate and in contact with the first adjustment region;

forming a first hole and a second hole through the first dielectric layer such that the first and second holes are located above the first adjustment region;

placing a first metal contact into the first hole and a second metal contact into the second hole such that the first and second metal contacts are each electrically connected to the first adjustment region;

depositing a polysilicon resistive layer onto the first dielectric layer above the first adjustment region and between the first and second metal contacts;

depositing a second dielectric layer on top of the polysilicon resistive layer such that it extends beyond and around the polysilicon resistive layer;

forming a third hole and a fourth hole in the second dielectric layer such that the third and fourth holes are located above the polysilicon resistive layer;

placing a first metal resistor contact into the third hole and a second metal resistor contact into the fourth hole such that the first and second metal resistor contacts are each electrically connected to the polysilicon resistive layer;

depositing a second adjustment layer on top of the second dielectric layer above the polysilicon resistive layer and between the first and second metal resistor contacts;

adapting the polysilicon resistive layer to act as a variable resistor by connecting the first and second metal resistor contacts to an electrical circuit;

connecting a first voltage source between the first metal contact and the second metal contact to create a first voltage across the first adjustment region;

connecting a second voltage source between a first edge of the second adjustment layer and a second edge of the second adjustment layer to create a second voltage across the second adjustment region;

varying the first voltage across the first adjustment region to cause a change in a resistance of the variable resistor; and varying the second voltage across the second adjustment region to cause a further change in the resistance of the variable resistor.

35. The method of claim 34, wherein the step of connecting a first voltage source between the first metal contact and the second metal contact further comprises:

connecting a standard output of a digital-to-analog converter (DAC) to the first metal contact; and connecting a complementary output of the DAC to the second metal contact.

36. The method of claim 34, wherein the step of connecting a second voltage source between the first edge and the second edge of the second adjustment region further comprises:

connecting a standard output of a digital-to-analog converter (DAC) to the first edge of the second adjustment region; and connecting a complementary output of the DAC to the second edge of the second adjustment region.

37. The method of claim 34, wherein the step of varying the first voltage across the first adjustment region further comprises:

detecting a voltage applied across the polysilicon resistive layer by the electrical circuit; and adjusting the first voltage across the first adjustment region to maintain a substantially constant voltage offset between the voltage applied across the polysilicon resistive layer by the electrical circuit and the first voltage applied across the first adjustment region.

38. The method of claim 34, wherein the step of varying the second voltage across the second adjustment region further comprises:

detecting a voltage applied across the polysilicon resistive layer by the electrical circuit; and adjusting the second voltage across the second adjustment region to maintain a substantially constant voltage offset between the voltage applied across the polysilicon resistive layer by the electrical circuit and the second voltage applied across the second adjustment region.

39. The method of claim 34, further comprising:

creating additional variable resistors by the steps of:

depositing an additional polysilicon resistive layer onto the first dielectric layer above the adjustment region and between the first and second metal contacts;

depositing an additional dielectric layer above the additional polysilicon layer;

providing additional metal contacts protruding through the additional dielectric layer to make electrical contact with the additional polysilicon layer;

depositing an additional adjustment layer above the additional dielectric layer above the additional polysilicon layer;

adapting the additional polysilicon resistive layer to act as an additional variable resistor by connecting the additional metal contacts to an electrical circuit;

connecting an additional voltage source between a first edge and a second edge of the additional adjustment layer;

varying a voltage of the additional voltage source to further adjust a resistance of the additional polysilicon layer; and repeating the steps of depositing an additional polysilicon resistive layer, depositing an additional dielectric layer, providing additional metal contacts, depositing an additional adjustment layer, adapting the additional polysilicon layer to act as a variable resistor, and connecting an additional voltage source to the additional adjustment layer until a desired number of variable resistors is created.

* * * * *